US007984706B2

(12) United States Patent
Stewart, Jr. et al.

(10) Patent No.: US 7,984,706 B2
(45) Date of Patent: Jul. 26, 2011

(54) CONTROL METHOD FOR CLOSED LOOP OPERATION WITH ADAPTIVE WAVE FORM OF AN ENGINE FUEL INJECTOR OIL OR FUEL CONTROL VALVE

(75) Inventors: Robert T. Stewart, Jr., Lexington, SC (US); Ricky Lee Dynes, Toney, AL (US); Benjamin Daniel Wisdom, Columbia, SC (US)

(73) Assignee: Continental Automotive Systems US, Inc., Auburn Hills ( * ) Notice: Subject to any disclaimer, the term of this patent is extended or adjusted under 35 U.S.C. 154(b) by 468 days.

(21) Appl. No.: 12/289,176

(22) Filed: Oct. 22, 2008

(65) Prior Publication Data

US 2009/0139490 A1 Jun. 4, 2009

Related U.S. Application Data

(60) Provisional application No. 61/005,150, filed on Dec. 3, 2007.

(51) Int. Cl.
*F02M 37/04* (2006.01)
*H01H 9/00* (2006.01)

(52) U.S. Cl. ..... 123/467; 251/129.04; 251/129.09; 361/160

(58) Field of Classification Search ..... 123/467, 123/472; 251/129.04, 129.09, 129.01, 129.18; 361/152, 160, 154; 335/253, 256, 257
See application file for complete search history.

(56) References Cited

U.S. PATENT DOCUMENTS

| | | | | |
|---|---|---|---|---|
| 5,497,093 | A * | 3/1996 | Sundeen et al. | 324/415 |
| 5,720,261 | A * | 2/1998 | Sturman et al. | 123/446 |
| 5,722,373 | A * | 3/1998 | Paul et al. | 123/446 |
| 5,954,030 | A * | 9/1999 | Sturman et al. | 123/446 |
| 6,081,413 | A * | 6/2000 | Schmitz et al. | 361/160 |
| 6,373,363 | B1 * | 4/2002 | Spakowski et al. | 335/256 |
| 6,474,353 | B1 * | 11/2002 | Sturman et al. | 137/1 |
| 6,483,689 | B1 * | 11/2002 | Koch et al. | 361/160 |
| 6,737,946 | B2 * | 5/2004 | Seale et al. | 335/279 |
| 6,925,975 | B2 * | 8/2005 | Ozawa et al. | 123/90.11 |
| 7,099,136 | B2 * | 8/2006 | Seale et al. | 361/152 |
| 7,216,630 | B2 | 5/2007 | Martin et al. | |
| 2003/0172205 | A1 * | 9/2003 | Bastian | 710/45 |

* cited by examiner

*Primary Examiner* — Thomas N Moulis

(57) ABSTRACT

A method and system controls motion of an armature 112 of a fuel injector 100. The armature moves between an open coil 118 and a close coil 116 of the injector. Acceleration current of a certain polarity is applied to the open coil 118 with the armature disposed at the close coil 116. De-latching current of a polarity opposite of the certain polarity is applied to the close coil 116 to release magnetic latch on the armature thereby accelerating movement of the armature towards the open coil 118. Deceleration current is applied the close coil 116 thereby decelerating the armature prior to reaching the open coil. Latching current of the certain polarity is applied to the open coil 118 prior to or just after impact of the armature 112 with the open coil 118 to magnetically latch the armature to the open coil 118 thereby reducing bounce of the armature at impact.

17 Claims, 3 Drawing Sheets

CONTROL METHOD FOR CLOSED LOOP OPERATION WITH ADAPTIVE WAVE FORM OF AN ENGINE FUEL INJECTOR OIL OR FUEL CONTROL VALVE

This application claims the benefit of the earlier filing date of U.S. Provisional Application No. 61/005,150, filed on Dec. 3, 2007, which is incorporated by reference herein in its entirety.

FIELD OF THE INVENTION

This invention relates to oil activated fuel injectors and, more particularly, to a system and method to control motion of an armature of the injector using closed loop operation with adaptive current or voltage wave forms.

BACKGROUND OF THE INVENTION

In hydraulically actuated fuel injection systems, a control valve body is provided with a valve system having grooves or orifices which allow fluid communication between working ports, high pressure ports, and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In current configurations, a driver will deliver a current or voltage to an open side of an open coil solenoid. The magnetic force generated in the open coil solenoid will shift an armature into the open position so as to align grooves of the control valve body and the armature. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, the armature has a tendency to bounce or repeatedly impact against the open coil during the opening stroke. During this bouncing, it is difficult to control the armature motion and hence results in the inability to efficiently control the supply of fuel to the combustion chamber of the engine. For example, in conventional systems it is not possible to quickly move the armature away from the open coil in order to minimize the bouncing effect during an injection of a pilot quantity of fuel. Accordingly, the initial quantity of fuel provided during the pre-stroke event cannot be easily controllable, resulting in a larger injection quantity of fuel than desired. This may result in a retarded start of injection, as well as the inability to control the armature and hence the injection of a small, pilot quantity of fuel. That is, during this bouncing or repeated impact, a small quantity of fuel cannot be metered accurately in order to efficiently inject this small quantity of fuel into the combustion chamber of an engine. Additionally, it is also very difficult, if not impossible, to vary the amount of fuel during this small injection.

Thus, injection shot-to-shot variations can occur on a single fuel injector.

It is also known that the bouncing phenomenon may differ from injector to injector, and over time. For example, different manufacturing tolerances may affect the bouncing phenomenon from, for example, small variations in armature diameter to different coil characteristics. Additionally, over time, in the same injector, variations may result from different operating conditions such as temperature and wear on the parts due to aging and other factors. Hence, the control of fuel quantity may vary from fuel injector to fuel injector, as well as over time with the same fuel injector. This also may lead to higher emissions and engine noise. Thus, injector shot-to-shot variations can occur on the same engine between multiple injectors.

The shot-to-shot variations mentioned above can cause idle stability issues that are detectable by the vehicle's operator and can cause decreased engine efficiency and increased emissions. Currently, manufacturing tolerances of the injector require sorting or rework to improve shot-to-shot variations.

Thus, there is a need to reduce injector shot-to-shot variations in an injection system by reducing the bounce of an armature of a control valve of the system.

SUMMARY OF THE INVENTION

An object of an embodiment is to fulfill the need referred to above. In accordance with the principles of the present invention, this objective is achieved by a method of controlling motion of an armature of a fuel injector. The armature is constructed and arranged to move between an open coil and a close coil of the injector. The method applies acceleration current of a certain polarity for a certain amount of time to the open coil with the armature disposed at the close coil. A de-latching current of a polarity opposite of that of the certain polarity is applied for a certain amount of time to the close coil to release magnetic latch on the armature thereby accelerating movement of the armature towards the open coil. A deceleration current is applied for a certain amount of time to the close coil thereby decelerating the armature prior to reaching the open coil. A latching current of the certain polarity is applied for a certain amount of time to the open coil prior to or just after impact of the armature with the open coil to magnetically latch the armature to the open coil thereby reducing bounce of the armature at impact.

In accordance with another aspect of an embodiment, a control system for controlling motion of an armature of a fuel injector includes at least one fuel injector having an armature constructed and arranged to move between an open coil and a close coil, and a controller constructed and arranged to apply 1) acceleration current of a certain polarity for a certain amount of time to the open coil with the armature disposed at the close coil, 2) de-latching current of a polarity opposite of that of the certain polarity for a certain amount of time to the close coil to release magnetic latch on the armature thereby accelerating movement of the armature towards the open coil, 3) deceleration current for a certain amount of time to the close coil thereby decelerating the armature prior to reaching the open coil; and 4) a latching current of the certain polarity for a certain amount of time to the open coil prior to or just after impact of the armature with the open coil to magnetically latch the armature to the open coil thereby reducing bounce of the armature at impact.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
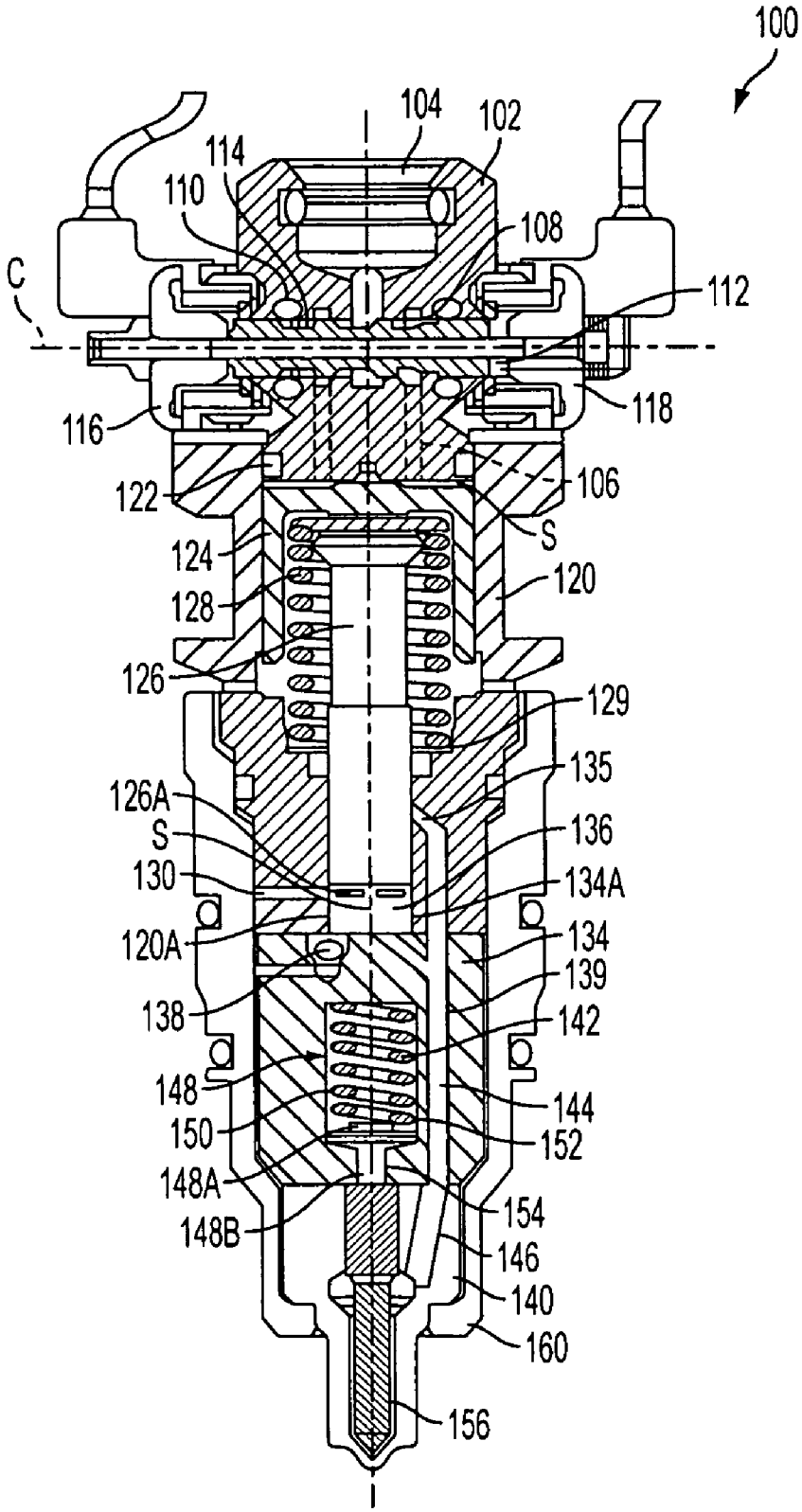
FIG. 1 shows an oil activated fuel injector provided in accordance with an embodiment of the present invention.

With reference to FIG. 1, an overview of a fuel injector in accordance with the invention is shown. It should be understood, though, that the injector shown in FIG. 1 is provided as one illustrative example, and that other configurations, features and the like may also be equally used with the invention. Accordingly, the fuel injector of FIG. 1 and the features described herein are not to be considered a limiting feature of the embodiment.

The fuel injector, generally indicated at 100, can be of the type disclose din U.S. Pat. No. 7,216,630 B2, the content of which is hereby incorporated by reference into this specification. The fuel injector 100 includes a control valve body 102 as well as an intensifier body 120 and a nozzle 140. The control valve body 102 includes an inlet area 104 which is in fluid communication with working ports 106. At least one groove or orifice (hereinafter referred to as grooves) 108 is positioned between and in fluid communication with the inlet area 104 and the working ports 106. At least one of vent hole 110 (and preferably two ore more) is located in the control body 102 which is in fluid communication with the working ports 106.

An armature 112, in the form of a spool, having at least one groove or orifice (hereinafter referred to as grooves) 114 is slidably mounted within the control valve body 102. An open coil 118 and a closed coil 116 are positioned on opposing sides of the armature 112 and are energized via a driver (not shown) to drive the armature 112 between a closed position and an open position. In the open position, the grooves 114 of the armature 112 are aligned with the grooves 108 of the valve control body 102 thus allowing the working fluid to flow between the inlet area 104 and the working ports 106 of the valve control body 102.

The intensifier body 120 is mounted to the valve control body 102 via any conventional mounting mechanism. A seal 122 (e.g., o-ring) may be positioned between the mounting surfaces of the intensifier body 120 and the valve control body 102. A piston 124 is slidably positioned within the intensifier body 120 and is in contact with an upper end of a plunger 126. An intensifier spring 128 surrounds a portion (e.g., shaft) of the plunger 126 and is further positioned between the piston 124 and a flange or shoulder 129 formed on an interior portion of the intensifier body 120. The intensifier spring 128 urges the piston 122 and the plunger 126 towards a first position proximate to the valve control body 102. A pressure release hole 130 is formed in the body of the intensifier body 120. The pressure release hole 130 may be further positioned adjacent the plunger 126.

As shown in FIG. 1, a check disk 134 may be positioned below the intensifier body 120 remote from the valve control body 102. The combination of an upper surface 134*a* of the check disk 134, an end portion 126*a* of the plunger 126 and an interior wall 120*a* of the intensifier body 120 forms the high pressure chamber 136. A fuel inlet check valve 138 is positioned within the check disk 134 and provides fluid communication between the high pressure chamber 136 and a fuel area (not shown). This fluid communication allows fuel to flow into the high pressure chamber 136 from the fuel area during an up-stroke of the plunger 126. The pressure release hole 130 is also in fluid communication with the high pressure chamber 136 when the plunger 126 is urged into the first position; however, fluid communication is interrupted when the plunger 126 is urged downwards towards the check disk 134. The check disk 134 also includes a fuel bore 139 in fluid communication with a fuel bore 135 in the intensifier body 120. The fuel bore 135 is in fluid communication with the high pressure chamber 136.

FIG. 1 further shows the nozzle 140 and a spring cage 142. The spring cage 142 is positioned between the nozzle 140 and the check disk 134, and includes a fuel bore 144 in fluid communication with the fuel bore 139 of the check disk 134. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second smaller bore diameter 148*b*. The nozzle 140 includes an angled bore 146 in alignment with the bore 139 of the spring cage 142. A needle 156 is preferably centrally located with the nozzle 140 and is urged downwards by the spring 150 (via the pin 154). A fuel chamber 152 surrounds the needle 150 and is in fluid communication with the bore 146. In embodiments, a nut 160 is threaded about the intensifier body 120, the check disk 134, the nozzle 140 and the spring cage 142.

Figure 2:
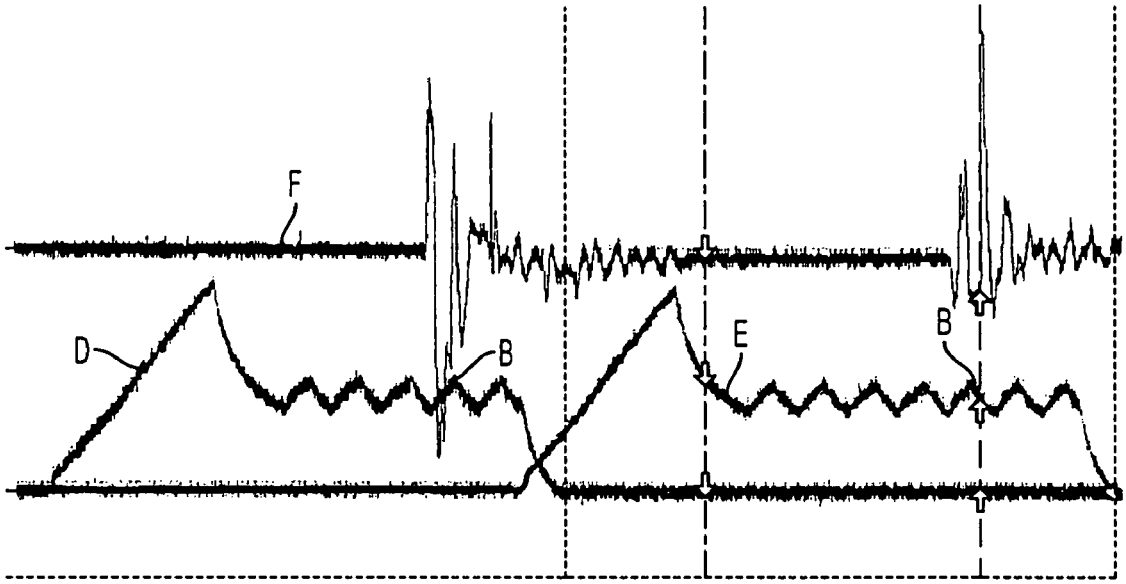
FIG. 2 PRIOR ART
FIG. 2 shows current waveforms of open and close coils of a conventional control valve body.

With reference to FIG. 2, conventional fixed coil waveforms are shown with period control between pulses to control fuel quantity. Current waveform D is of the open coil 118 and current waveform E is of the close coil 116. Waveform F is of accelerometer impact forces. Portion B of the waveforms D and E indicates the bounce of the armature resulting in wasted energy.

Returning to FIG. 1, a control "C" is used to control and monitor different parameters of the injector 100. The control "C" may, for example, control, monitor and/or regulate the current provided to the open coil 118 and closed coil 116. In this way, the control "C" can control, monitor and/or regulate the movement of the armature 112 between a closed position and an open position. By way of example, the electronic properties, e.g., back EMF, can be monitored by the control "C". Thus, closed loop operation is performed by measuring the voltage created by the motion of the armature 112 as it is pulled from the non-energized coil (e.g., coil 116) to the energized coil (e.g., coil 118). The resultant signals can then be used to estimate the movement of the armature 112 in either direction, and impact of the armature and will be explained more fully below. The control C can be considered to be a controller that is preferably part of an engine control unit (not shown) of a vehicle. The controller can control all the fuel injectors of the vehicle.

Figure 4:
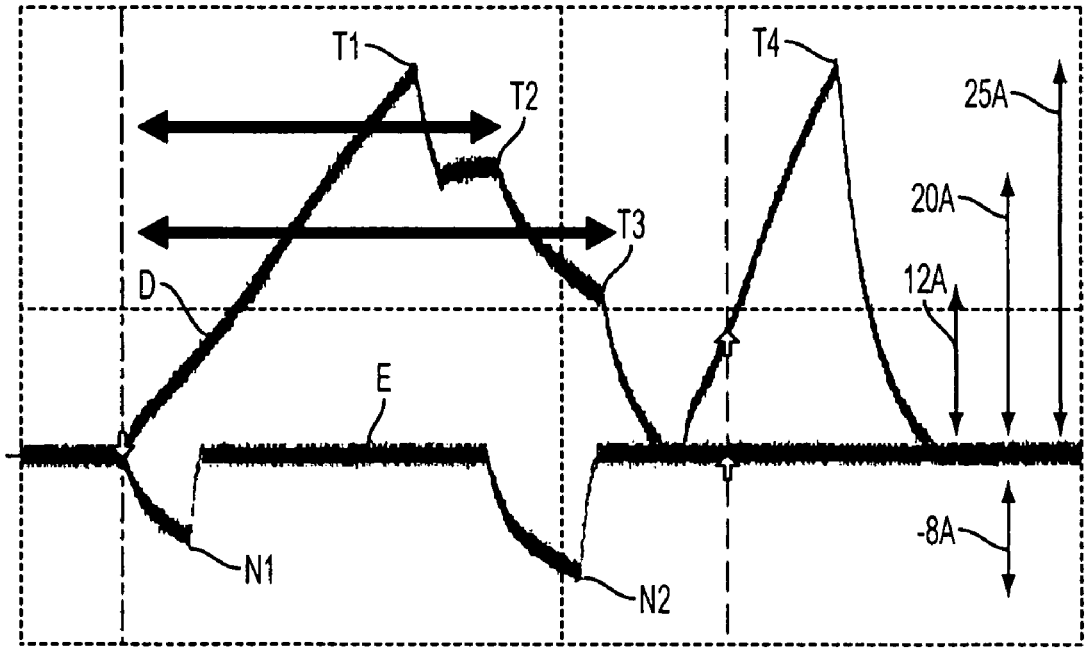
FIG. 4 shows a current waveform and the use of negative current and back EMF as feedback to minimize armature bounce in accordance with an embodiment of the invention.

With reference to FIG. 4, a "negative current" can be used to counteract residual magnetism in a coil and thus reduce the bounce of armature 112. Adaptive current waveform D shows the initial acceleration current of a certain polarity provided to the open coil 118. At T1, a peak pulse of 25 amps accelerates the armature 112. Current waveform E is of the close coil 116 and N1 indicates a first application of "negative current" on the close coil 116. The application of the negative current N1 can occur slightly before or generally simultaneously with the application of the acceleration current D.

As used herein, the "negative current" is a de-latching current of a polarity opposite of that of the acceleration current to release the armature 112 from the close coil 116, allowing an earlier motion and increase acceleration of the armature 112 toward the open coil 118. More particularly, on simple coil pole piece and armature, when the coil is energized, the coil pulls the armature to the coil. When electrical power is removed, the armature continues to be latched to the pole piece as the stored magnet field holds the parts. By applying an opposite polarity current (the negative current), the stored magnetic field is removed. The application of this negative current allows the opposite coil and pole piece assembly to pull armature with less magnetic resistance from unpowered coil resulting in faster acceleration and improved stability of motion.

The acceleration current D to open coil 118 can be stepped down to 20 amps at T2. Also at T2, a second application of negative current N2 (or deceleration current) is applied on the close coil 116 to decelerate the armature 112 by applying electromagnetic force on the close coil 116 when the armature is moving in the opposite direction toward the open coil 118. The polarity of the N2 is shown to be opposite that of the acceleration current D, but the polarity of N2 is immaterial once the magnetic field is drained from the close coil 116. The acceleration current D to open coil 118 can be stepped down to 12 amps at T3. Stepping-down of the current D helps control bounce of the armature 112. At T4, a peak pulse of 25 amps as a latching current is applied to the open coil 118 prior to or just after impact of the armature 112 with the open coil 118 to magnetically latch the armature 112 to the open coil 118 thereby eliminating or at least reducing the bounce of the armature 112 at impact.

As should be known to those of skill in the art, inductance is a property associated with the wire wound about the open coil or the closed coil. The origin of inductance is that the current flowing through the wire builds up a magnetic field around the wire. Energy is stored in this field and when the current changes in the coil, some energy must be transferred to or from the field which occurs by the field causing a voltage drop across the conductor while the current is changing. The voltage drop (back EMF) will be proportional to the derivative of the current change over time, and the sign of the voltage will be such as to try to resist the change in current. By monitoring this back EMF, an indication of the armature 112 travel and impact can be obtained (by knowing the current provided to the open coil and the distance the armature must travel to the open coil).

Figure 3:
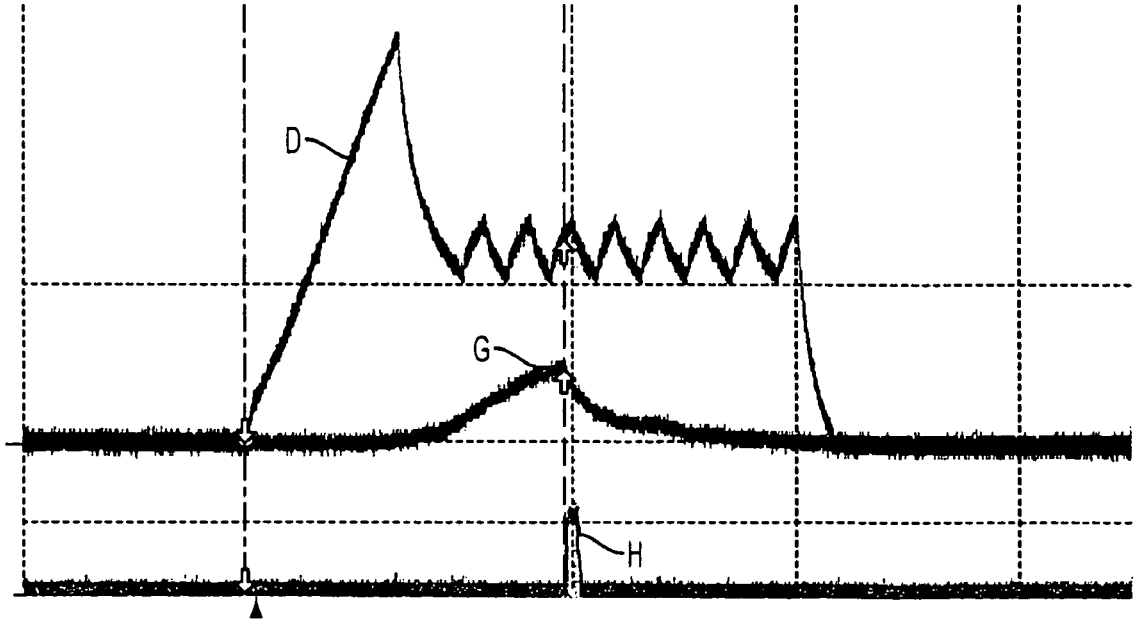
FIG. 3 shows a current waveform and back electro-magnetic force (EMF) indicating when an armature of a conventional control valve body hits the coil.

With reference to FIG. 3, the current waveform D of FIG. 2 is shown. Waveform G shows the back EMF (electro-magnetic force) voltage generated by solenoid motion and indicates armature 112 impact with a coil. The waveform H shows the detection of the impact at the end of armature travel. By using sample-based feedback back by utilizing back EMF signals, changes of the armature motion over the lifetime of the injector can be compensated for due to, for example, temperature changes, wear conditions, magnetic properties, all surface related effects (adhesion, cohesion, friction), fluctuations in working fluid pressure and the like, by adjusting the timing values for the open coil and close coil, e.g., adjusting the timing of the current provided to the open coil and close coil. More particularly, closed-loop operation is used to adjust the timing or amplitude of the deceleration current to maintain consistent end of motion time.

Advantages of the embodiment include:

1. Compliance with new, more restrictive customer specifications on injector shot-to-shot variations to meet new emissions requirements.
2. Compliance with new more restrictive customer specifications on injector shot-to-shot variations between injectors to meet new emissions requirements.
3. Increased injector life with improved stable performance over the increased life.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the scope of the following claims.

What is claimed is:

1. A method of controlling motion of an armature of a fuel injector, the armature being constructed and arranged to move between an open coil and a close coil of the injector, the method including the steps of:

applying acceleration current of a certain polarity for a certain amount of time to the open coil with the armature disposed at the close coil, applying de-latching current of a polarity opposite of that of the certain polarity for a certain amount of time to the close coil to release magnetic latch on the armature thereby accelerating movement of the armature towards the open coil, applying deceleration current for a certain amount of time to the close coil thereby decelerating the armature prior to reaching the open coil; and applying a latching current of the certain polarity for a certain amount of time to the open coil prior to or just after impact of the armature with the open coil to magnetically latch the armature to the open coil thereby reducing bounce of the armature at impact.

2. The method of claim 1, wherein the step of applying the acceleration current includes provident a current of 25 amps.

3. The method of claim 2, wherein at the time of applying the deceleration current, the method further includes stepping down the acceleration current to 20 amps.

4. The method of claim 3, wherein after the certain amount of time of deceleration current, the method further includes stepping down the acceleration current to 12 amps.

5. The method of claim 1, wherein the steps of applying the latching current includes applying the latching current at 25 amps.

6. The method of claim 1, wherein the steps of applying the acceleration current and the de-latching current occur generally simultaneously.

7. The method of claim 1, further including determining, in a sampling manner, armature travel and when impact of the armature occurs with a coil by monitoring back electro-magnetic force of the coil.

8. The method of claim 7, further including, based on the determining step, compensating for change of armature motion from expected motion thereof by adjusting timing of current provided to the open and close coils.

9. A control system for controlling motion of an armature of a fuel injector, the system comprising:

at least one fuel injector including an armature constructed and arranged to move between an open coil and a close coil, and a controller constructed and arranged to apply 1) acceleration current of a certain polarity for a certain amount of time to the open coil with the armature disposed at the close coil, 2) de-latching current of a polarity opposite of that of the certain polarity for a certain amount of time to the close coil to release magnetic latch on the armature thereby accelerating movement of the armature towards the open coil, 3) deceleration current for a certain amount of time to the close coil thereby decelerating the armature prior to reaching the open coil; and 4) a latching current of the certain polarity for a certain amount of time to the open coil prior to or just after impact of the armature with the open coil to magnetically latch the armature to the open coil thereby reducing bounce of the armature at impact.

10. The system of claim 9, wherein the controller applies the acceleration current at 25 amps.

11. The system of claim 10, wherein at the time of applying the deceleration current, the controller steps down the acceleration current to 20 amps.

12. The system of claim 11, wherein after the certain amount of time of deceleration current, the controller further steps down the acceleration current to 12 amps.

13. The system of claim 9, wherein the controller applies the latching current at 25 amps.

14. The system of claim 9, wherein the controller applies the acceleration current and the de-latching current generally simultaneously.

15. The system of claim 9, wherein the controller is constructed and arranged to determine, in a sampling manner, armature travel and when impact of the armature occurs with a coil by monitoring back electro-magnetic force of the coil.

16. The system of claim 15, wherein the controller, based on the monitored back EMF, compensates for change of armature motion from expected motion thereof by adjusting timing of current provided to the open and close coils.

17. A control system for controlling motion of an armature of a fuel injector, the system comprising:

at least one fuel injector including an armature constructed and arranged to move between an open coil and a close coil, and means for applying 1) acceleration current of a certain polarity for a certain amount of time to the open coil with the armature disposed at the close coil, 2) de-latching current of a polarity opposite of that of the certain polarity for a certain amount of time to the close coil to release magnetic latch on the armature thereby accelerating movement of the armature towards the open coil, 3) deceleration current for a certain amount of time to the close coil thereby decelerating the armature prior to reaching the open coil; and 4) a latching current of the certain polarity for a certain amount of time to the open coil prior to or just after impact of the armature with the open coil to magnetically latch the armature to the open coil thereby reducing bounce of the armature at impact.

* * * * *